US009433987B2

(12) United States Patent
Lin

(10) Patent No.: US 9,433,987 B2
(45) Date of Patent: Sep. 6, 2016

(54) MANUFACTURING METHOD FOR STAGE TUBE

(71) Applicant: Jui-Kun Lin, Taichung (TW)

(72) Inventor: Jui-Kun Lin, Taichung (TW)

( * ) Notice: Subject to any disclaimer, the term of this patent is extended or adjusted under 35 U.S.C. 154(b) by 150 days.

(21) Appl. No.: 14/308,116

(22) Filed: Jun. 18, 2014

(65) Prior Publication Data

US 2014/0373332 A1 Dec. 25, 2014

(30) Foreign Application Priority Data

Jun. 25, 2013 (TW) ..... 102122472 A

(51) Int. Cl.
*B21C 37/16* (2006.01)
*B21D 22/02* (2006.01)
*B21D 5/10* (2006.01)

(52) U.S. Cl.
CPC ..... *B21C 37/16* (2013.01); *B21D 5/10* (2013.01); *B21D 22/025* (2013.01); *Y10T 29/49826* (2015.01)

(58) Field of Classification Search
CPC ... B21C 37/06; B21C 37/08; B21C 37/0803; B21C 37/15; B21C 37/16; B21D 5/02; B21D 11/02; B21D 9/04; B21D 9/05; B21D 9/12; B21D 5/10; B21D 22/025
USPC ..... 228/137
See application file for complete search history.

(56) References Cited

U.S. PATENT DOCUMENTS 1,765,709 A * 6/1930 Withington ..... B21C 37/16 138/118
2,088,502 A * 7/1937 Arnold ..... H01B 17/26 174/152 R
6,782,921 B1 * 8/2004 Tsuru ..... B21C 37/08 138/142
6,877,652 B2 * 4/2005 Ooyauchi ..... B21C 37/06 228/170
6,883,552 B2 * 4/2005 Ooyauchi ..... B21C 37/08 138/177
6,915,821 B2 * 7/2005 Ooyauchi ..... B21C 37/06 138/177
7,484,298 B2 * 2/2009 Mellas ..... B21C 37/065 29/421.1
7,637,135 B2 * 12/2009 Homig ..... B21C 37/16 72/367.1
2003/0211352 A1 * 11/2003 Ooyauchi ..... B21C 37/0803 428/600
2011/0017338 A1 * 1/2011 Baxi ..... B21C 37/08 138/137

* cited by examiner

*Primary Examiner* — Alexander P Taousakis
*Assistant Examiner* — Pradeep C Battula
(74) *Attorney, Agent, or Firm* — Muncy, Geissler, Olds & Lowe, P.C.

(57) ABSTRACT

A manufacturing method for a stage tube that has a first tubular segment and a second tubular segment bordering mutually having different diameters includes: taking a metal plate that has a first segment and a second segment bordering mutually and having a first width and a second width, respectively, the first width being defined between two first paired edges, and the two second width being defined between two second paired edges; forming the first and second segments so as to define a first edge interval; rolling up the first and second segments so that the two first paired edges are jointed together and form the first tubular segment, while the second segment is formed to define a second edge interval; and rolling up the second segment so that the two second paired edges are jointed and form the second tubular segment.

17 Claims, 7 Drawing Sheets

MANUFACTURING METHOD FOR STAGE TUBE

BACKGROUND OF THE INVENTION

1. Technical Field

The present invention relates to manufacturing methods for tubes, and more particularly to a method for manufacturing a stage tube from a plate.

2. Description of Related Art

Conventionally, stage tubes are manufactured by processing solid shafts into tubes having a stage outer wall and an axial channel. This traditional approach cause, however, waste of material and time as well as processing work. While casting is an alternative manufacturing method, the related process is nevertheless complicated.

Particularly, according to the current technology, it is difficult to make a tube having its middle segment diametrically greater than its two end segments.

Therefore, the conventional technology for making stage tubes is needed to be improved.

SUMMARY OF THE INVENTION

In view of the need, it is the primary objective of the present invention to provide a manufacturing method for a stage tube, which manufactures stage tubes with even wall thickness more easily.

For achieving this and other objectives, the present invention provides a manufacturing method for a stage tube that has a first tubular segment and a second tubular segment bordering mutually and having different diameters, the manufacturing method comprising the steps of: a plat-preparing step: taking a metal plate that has a first segment and a second segment bordering mutually and having a first width and a second width, respectively, the first width being defined between two first paired edges, and the second width being defined between two second paired edges, wherein the first width is greater than the second width; a first molding step: forming the first segment and the second segment so as to define a first edge interval; a second molding step: rolling up the first segment and the second segment so that the two first paired edges defining the first width of the first segment are jointed together and form the first tubular segment, while the second segment is formed to define a second edge interval; and a third molding step: rolling up the second segment so that the two second paired edges defining the second width of the second segment are jointed and form the second tubular segment.

DETAILED DESCRIPTION OF THE INVENTION

Figure 1:
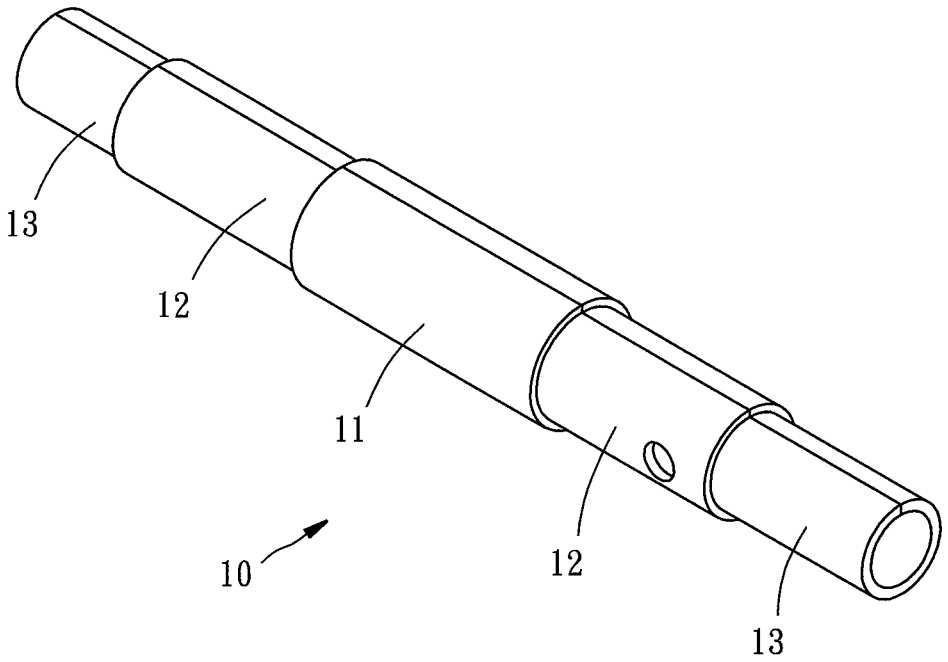
FIG. 1 is a perspective view of a stage tube according to one preferred embodiment of the present invention.
Figure 2:
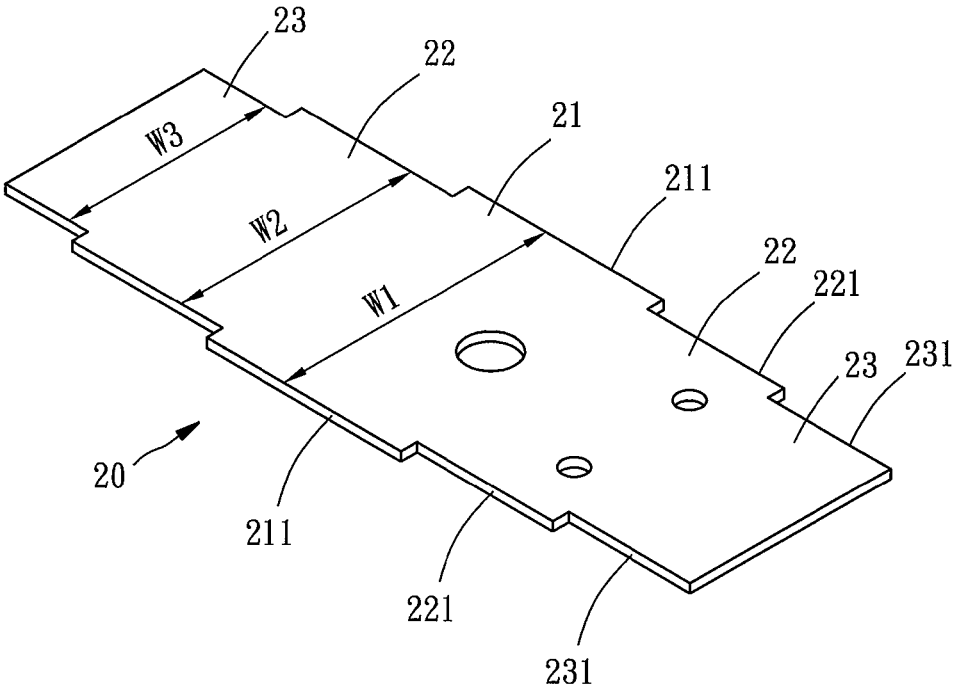
FIG. 2 is a perspective view of a plate for making the stage tube according to the preferred embodiment of the present invention.

Referring to FIG. 1, the present invention provides a manufacturing method for a stage tube. In one preferred embodiment, the stage tube 10 has a first tubular segment 11, two second tubular segments 12 bordering two opposite ends of the first tubular segment 11, and two third tubular segments 13 bordering outer ends of the two second tubular segments 12, respectively. The segments have their outer diameters gradually reduced in order.

As shown in FIG. 2 through FIG. 14, in one preferred embodiment of the present invention, a manufacturing method for a stage tube has the steps described below.

A plat-preparing step: a metal plate 20 has a first segment 21 and a second segment 22 bordering mutually and having a first width W1 and a second width W2, respectively, is prepared. Therein, the first width W1 is greater than the second width W2. The first width W1 is defined between two first paired edges 211, and the second width W2 is defined between two second paired edges 221. Therein, two said second segments 22 are provided to border two opposite ends of the first segment 21, respectively. In addition, the metal plate 20 has a third segment 23 bordering the second segment 22. The third segment 23 has a third width W3 that is smaller than the second width W2. The third width W3 is defined between two third paired edges 231.

Figure 3:
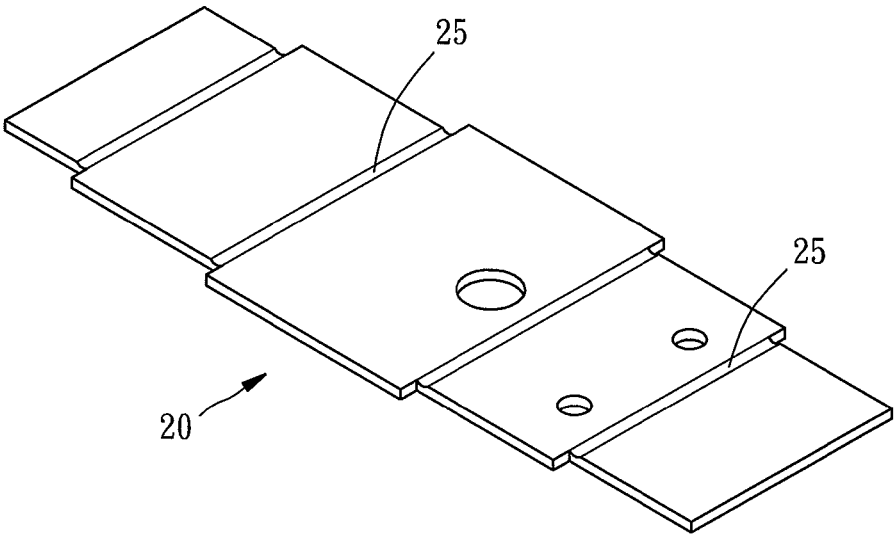
FIG. 3 is a perspective view of the plate with creases according to the preferred embodiment of the present invention.
Figure 4:
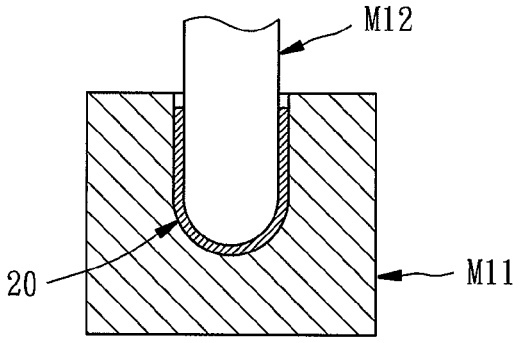
FIG. 4 is a schematic drawing showing mold closing in a first molding step according to the preferred embodiment of the present invention.
Figure 5:
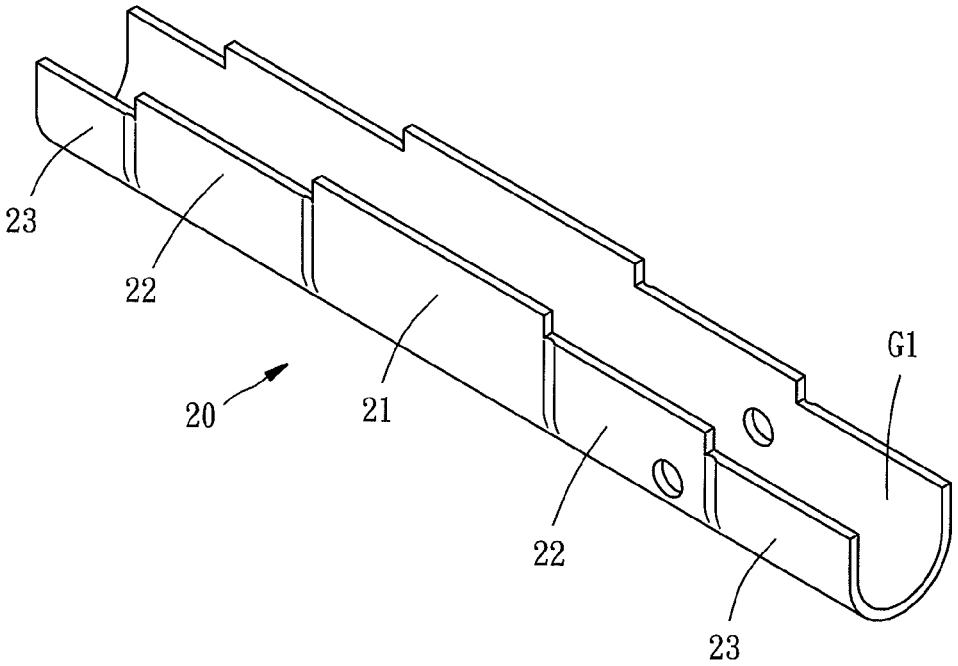
FIG. 5 is a perspective view of a semi-finished product of the stage tube formed in the first molding step according to the preferred embodiment of the present invention.
Figure 6:
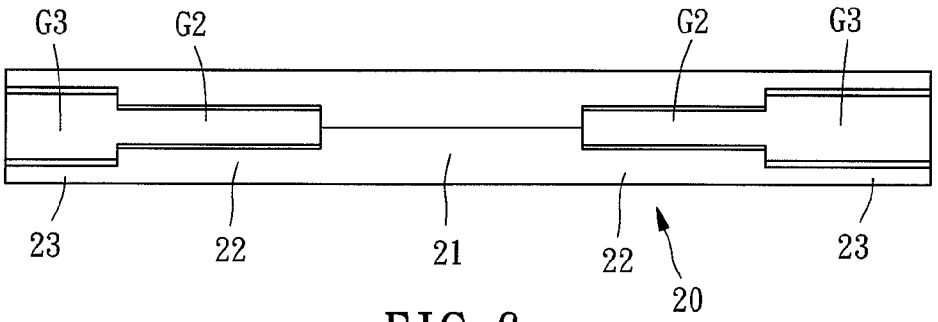
FIG. 6 is a top view of the semi-finished product of the stage tube formed, in the first molding step according to the preferred embodiment of the present invention.
Figure 7:
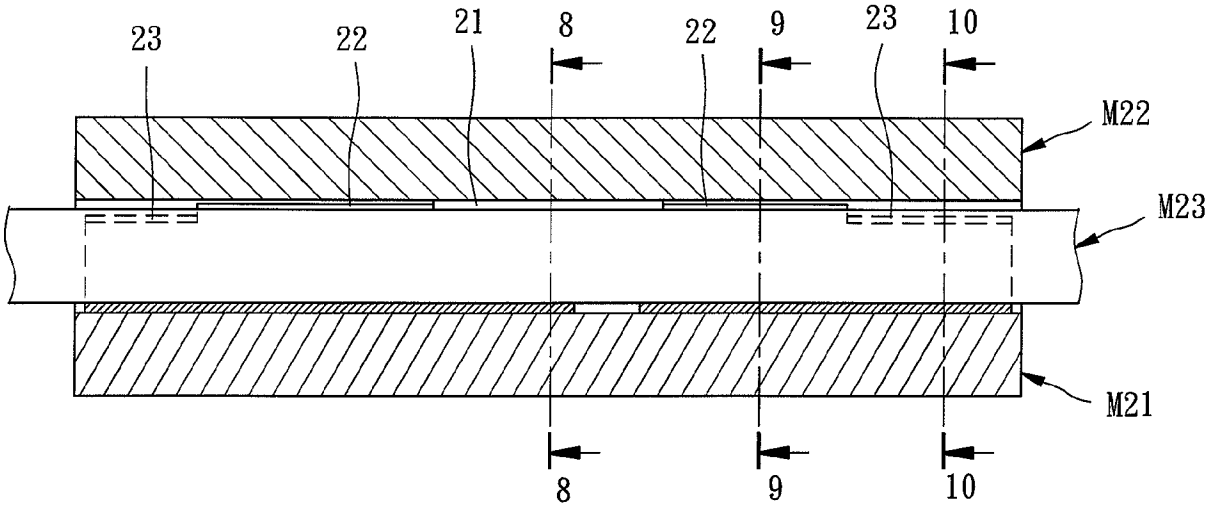
FIG. 7 is a cross-sectional drawing showing a second molding step according to the preferred embodiment of the present invention wherein the mold is not closed.
Figure 10:
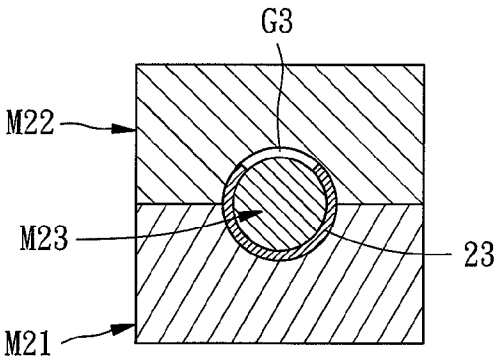
FIG. 10 is a cross-sectional drawing taken along Line 10-10 in FIG. 7 showing the mold is closed.
Figure 9:
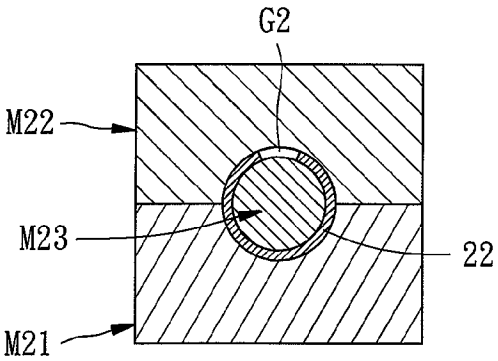
FIG. 9 is a cross-sectional drawing taken along Line 9-9 in FIG. 7 showing the mold is closed.
Figure 8:
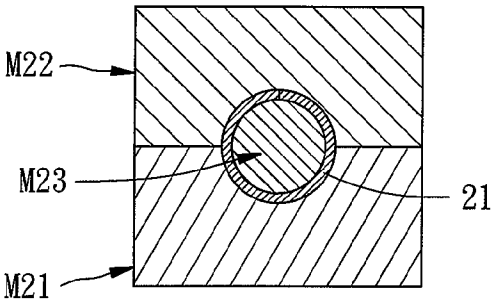
FIG. 8 is a cross-sectional drawing taken along Line 8-8 in FIG. 7 showing the mold is closed.
Figure 11:
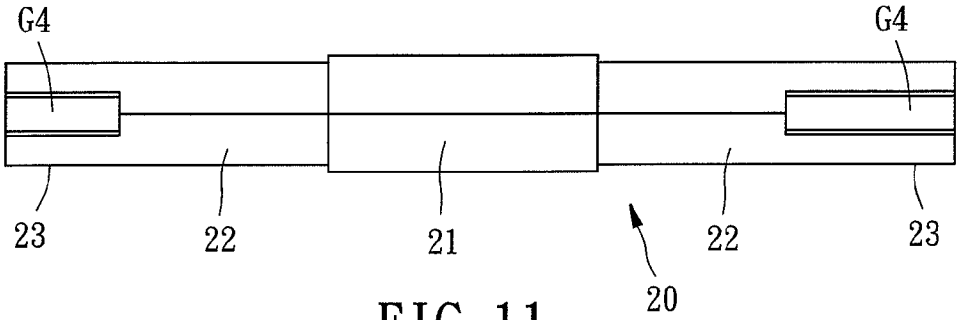
FIG. 11 is a top view of the semi-finished product of the stage tube formed in the third molding step according to the preferred embodiment of the present invention wherein the mold is not closed.
Figure 12:
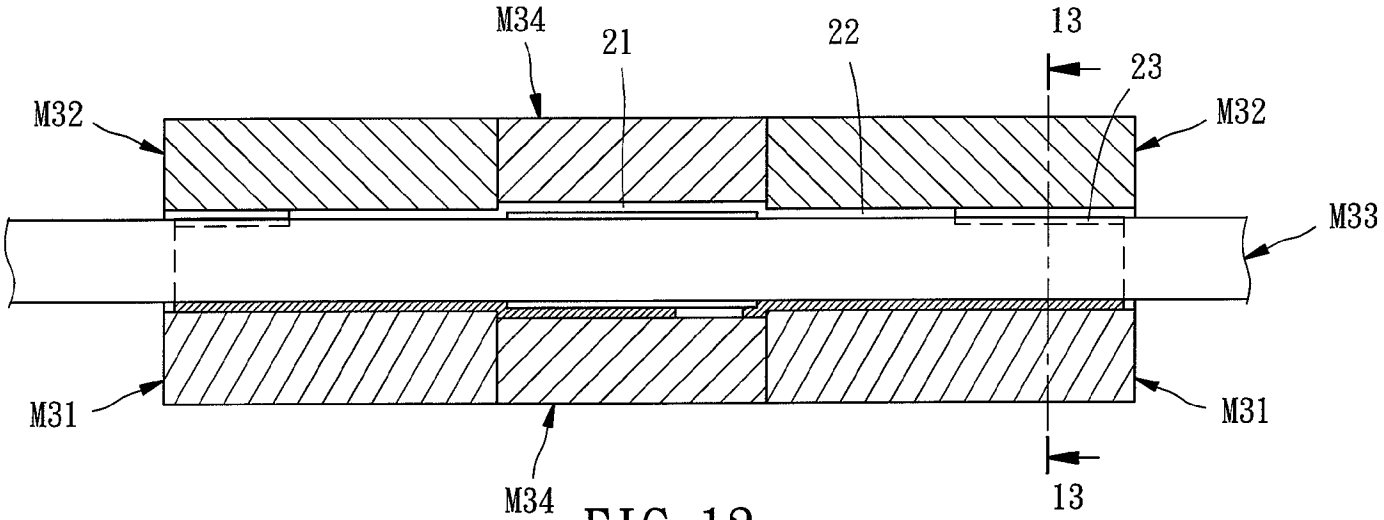
FIG. 12 is a cross-sectional drawing showing the third molding step according to the preferred embodiment of the present invention wherein the mold is not closed.
Figure 13:
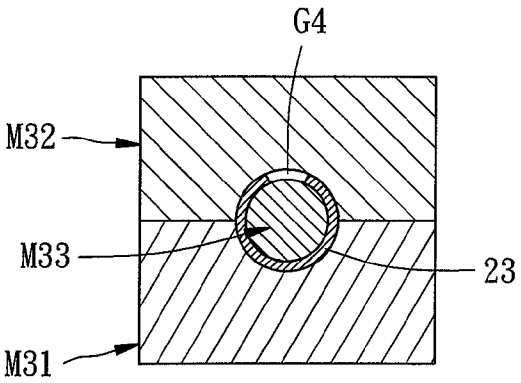
FIG. 13 is a cross-sectional drawing taken along Line 13-13 in FIG. 12 showing the mold is closed.
Figure 14:
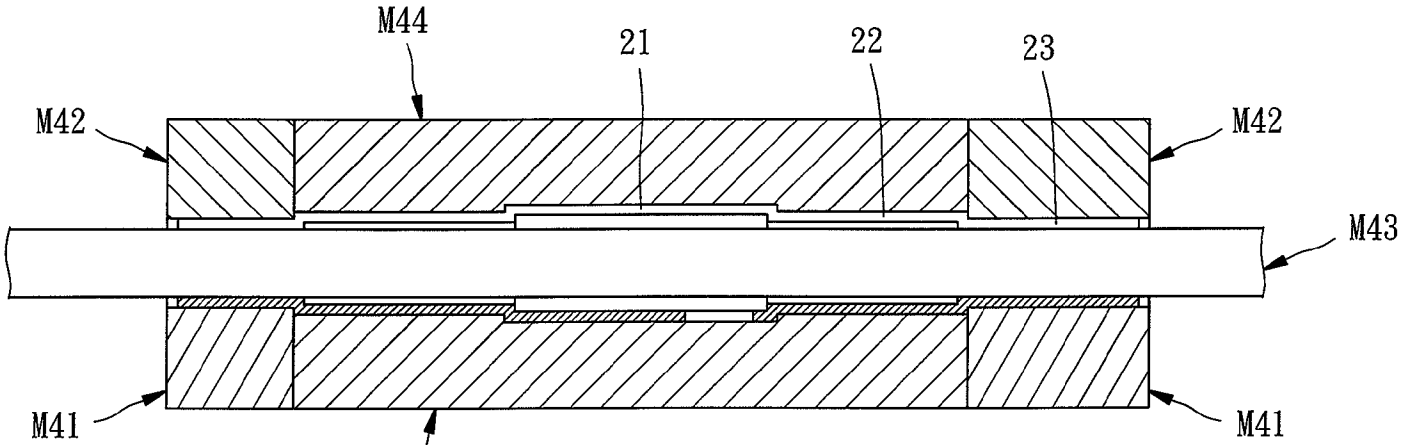
FIG. 14 is a cross-sectional drawing showing a fourth step according to the preferred embodiment of the present invention wherein the mold is not closed.

A creasing step: a crease 25 is formed between the first segment 21 and the second segment 22, and another crease 25 is formed between the second segment 22 and the third segment 23, as shown in FIG. 3, so that the material is easy to be extended and deformed in the following steps.

A first molding step: the first segment 21, the second segments 22 and the third segments 23 are formed into U shapes and a first edge interval G1 is thereby defined. In the first molding step, a first molding first part M11 and a first molding second part M12 are used to mold the metal plate 20.

A second molding step: the first segment 21, the second segments 22 and the third segments 23 are rolled up so that the two first paired edges 211 defining the first width W1 of the first segment 21 are joined together to form the first tubular segment 11, and each said second segment 22 defines a second edge interval G2. In the second molding step, a second molding first part M21 and a second molding second part M22 are used to hold the first segment 21 and the second segment 22 and a second molding stem M23 is used to prop up the metal plate 20 from inside. The second segment 22 is rolled up to define a second edge interval G2, and the third segment 23 is rolled up to define a third edge interval G3.

A third molding step: the second segment 22 is rolled up to make the two second paired edges 221 defining the second width W2 of the second segment 22 jointed together and form the second tubular segment 12. In the third molding step, a third molding first part M31 and a third molding second part M32 are used to round the second segment 22, and a third molding stem M33 is used to prop up the second segment 22 from inside. In the third molding step, the second segment 22 is diametrically displaced with respect to the first segment 21, so as to form the second tubular segment 12. In the present embodiment, the second tubular segments 12 are coaxial with the first tubular segment 11. The third segment 23 is rolled up to define a fourth edge interval G4. Therein, two third positioning members M34 are used to hold the formed first tubular segment 11 in place. The third molding first part M31 and the third molding second part M32 are fixedly positioned or radially displaceable with respect to the third positioning member M34.

A forth molding step: After the third molding step, the third segment 23 is rolled up to make the two third paired edges 231 defining the third width W3 of the third segment 23 jointed together. The forth molding step works similarly to the previous molding steps, while using a fourth molding first part M41, a fourth molding second part M42 and a fourth molding stem M43 for formation. In the present embodiment, two fourth positioning members M44 are used to hold the formed first tubular segment 11 and second tubular segment 12 in place. The fourth molding first part M41 and the fourth molding second part M42 are fixedly positioned or radially displaceable with respect to the fourth positioning members M44.

Then, soldering is applied to the joints for enhanced combination and structural strength.

Additionally, the tube made through the present embodiment may be further processed to incorporate more structural features, such as threads (not shown) around the third tubular segment 13. The other portions may also be finely processed by, for example, turning, grinding or polishing.

Thereby, the present embodiment allows rapid and accurate manufacturing of stage tubes, with the advantages of saving cost in terms of material and processing work.

In addition to the above embodiment, the present invention may also be realized with different alternatives.

For example, while the creasing step in performed before the first molding step as described above, for the material plate that is less hard or less thick, the formation may be achieved without performing the creasing step.

Alternatively, though the first tubular segment 11, the second tubular segments 12 and the third tubular segments 13 of the stage tube 10 are coaxial, they may be not coaxial. That is, these segments may have their axes eccentric, and form, for example an eccentric axial.

Furthermore, while soldering is applied to the joints in the above embodiment, such soldering may be saved if the strength is adequate.

Moreover, the present invention may be implemented by using either an integrated mold or a combining mold consisting of two or more mold parts, as required by the practical needs to achieve desired benefits, such as, reducing the number of mold parts used.

Also, the stage tube 10 made in the present invention is not limited to that has a first tubular segment 11, two second tubular segments 12 bordering two ends of the first tubular segment 11, and two third tubular segments 13 bordering outer ends of the two second tubular segments 12, with the outer diameters of the segments gradually reduced from the first 11 to the third 13 tubular segments. In fact, any stage tube having a first tubular segment 11 and a second tubular segment 12 that border mutually and have different diameters may be the product of the disclosed manufacturing method and protected by the present invention.

In addition, the third molding first part M31, the third molding second part M32 and the third molding stem M33 of the present invention are not limited to floating mold parts as mentioned above and may form a fixed mold instead. Similarly, the fourth molding first part M41, the fourth molding second part M42 and the fourth molding stem M43 are not limited to floating mold parts as mentioned above and may form a fixed mold instead.

To sum up, the disclosed manufacturing method allows stage formation on a single plate, so the manufacturing is relatively easy and ensures even wall thickness of the resulting tube, thereby by eliminating the disadvantages of the conventional process involving complicated cutting and excessive waste of material and achieving the objective of the present invention.

What is claimed is:

1. A manufacturing method for a stage tube that has a first tubular segment and a second tubular segment bordering mutually and having different diameters, the manufacturing method comprising the steps of:

a plate-preparing step: taking a metal plate that has a first segment and a second segment bordering mutually and having a first width and a second width, respectively, the first width being defined between two first paired edges, and the second width being defined between two second paired edges, wherein the first width is greater than the second width, wherein two of said second segments are provided, each bordering one of two opposite ends of the first segment, respectively;

a first molding step: forming the first segment and the second segment so as to define a first edge interval;

a second molding step: rolling up the first segment and the second segment so that the two first paired edges defining the first width of the first segment are jointed together and form the first tubular segment, while the second segment is formed to define a second edge interval; and a third molding step: rolling up the second segment so that the two second paired edges defining the second width of the second segment are jointed and form the second tubular segment.

2. The manufacturing method of claim 1, further comprising a creasing step performed before the first molding step, wherein the creasing step is forming a crease between the first segment and the second segment.

3. The manufacturing method of claim 1, wherein in the first molding step, a first molding first part and a first molding second part are used to mold the metal plate into an U shape.

4. The manufacturing method of claim 1, wherein in the second molding step, a second molding first part and a second molding second part are used to round the first segment and the second segment.

5. The manufacturing method of claim 1, wherein in the second molding step, a second molding stem is used to prop up the metal plate from inside.

6. The manufacturing method of claim 1, wherein in the third molding step, the second segment is diametrically displaced with respect to the first segment.

7. The manufacturing method of claim 1, wherein in the third molding step, a third molding first part and a third molding second part are used to round the second segment, and a third positioning member is used to hold the formed first tubular segment in place, in which the third molding first part and the third molding second part are fixedly positioned or radially displaceable with respect to the third positioning member.

8. The manufacturing method of claim 1, wherein in the third molding step, a third molding stem is used to prop up the second segment from inside.

9. The manufacturing method of claim 1, wherein the metal plate further has a third segment bordering the second segment, the third segment having a third width that is smaller than the second width and defined between two third paired edges, and wherein the manufacturing method further comprises a fourth molding step after the third molding step, in which the fourth molding step is to make two third paired edges defining the third width of the third segment jointed together.

10. A manufacturing method for a stage tube that has a first tubular segment and a second tubular segment bordering mutually and having different diameters, the manufacturing method comprising the steps of:

a plate-preparing step: taking a metal plate that has a first segment and a second segment bordering mutually and having a first width and a second width, respectively, the first width being defined between two first paired edges, and the second width being defined between two second paired edges, wherein the first width is greater than the second width;

a creasing step: forming a crease between the first segment and the second segment;

a first molding step: forming the first segment and the second segment so as to define a first edge interval;

a second molding step: rolling up the first segment and the second segment so that the two first paired edges defining the first width of the first segment are jointed together and form the first tubular segment, while the second segment is formed to define a second edge interval; and a third molding step: rolling up the second segment so that the two second paired edges defining the second width of the second segment are jointed and form the second tubular segment.

11. The manufacturing method of claim 10, wherein in the first molding step, a first molding first part and a first molding second part are used to mold the metal plate into an U shape.

12. The manufacturing method of claim 10, wherein in the second molding step, a second molding first part and a second molding second part are used to round the first segment and the second segment.

13. The manufacturing method of claim 10, wherein in the second molding step, a second molding stem is used to prop up the metal plate from inside.

14. The manufacturing method of claim 10, wherein in the third molding step, the second segment is diametrically displaced with respect to the first segment.

15. The manufacturing method of claim 10, wherein in the third molding step, a third molding first part and a third molding second part are used to round the second segment, and a third positioning member is used to hold the formed first tubular segment in place, in which the third molding first part and the third molding second part are fixedly positioned or radially displaceable with respect to the third positioning member.

16. The manufacturing method of claim 10, wherein in the third molding step, a third molding stem is used to prop up the second segment from inside.

17. The manufacturing method of claim 10, wherein the metal plate further has a third segment bordering the second segment, the third segment having a third width that is smaller than the second width and defined between two third paired edges, and wherein the manufacturing method further comprises a fourth molding step after the third molding step, in which the fourth molding step is to make two third paired edges defining the third width of the third segment jointed together.

* * * * *